US007121330B2

(12) United States Patent
Matsuzaki

(10) Patent No.: US 7,121,330 B2
(45) Date of Patent: Oct. 17, 2006

(54) HEAT EXCHANGE UNIT

(75) Inventor: Toyoaki Matsuzaki, Shizuoka-Ken (JP)

(73) Assignee: Xenesys Inc., Hyogo (JP)

( * ) Notice: Subject to any disclaimer, the term of this patent is extended or adjusted under 35 U.S.C. 154(b) by 732 days.

(21) Appl. No.: 10/327,852

(22) Filed: Dec. 26, 2002

(65) Prior Publication Data

US 2003/0145982 A1 Aug. 7, 2003

(30) Foreign Application Priority Data

Dec. 27, 2001 (JP) ..... P2001-397699

(51) Int. Cl.
*F28F 3/00* (2006.01)
*F28F 9/02* (2006.01)
*B21D 53/04* (2006.01)

(52) U.S. Cl. ..... 165/165; 165/166; 165/167; 165/173

(58) Field of Classification Search ..... 165/165, 165/166, 152, 153, 167, 173; 29/890.052, 29/890.043

See application file for complete search history.

(56) References Cited

U.S. PATENT DOCUMENTS 2,877,000 A * 3/1959 Person ..... 165/159
3,708,012 A * 1/1973 Zimprich ..... 165/152
4,183,402 A * 1/1980 Cotter ..... 165/175
4,657,072 A * 4/1987 Mulock-Bentley ..... 165/153
4,688,631 A * 8/1987 Peze et al. ..... 165/166
5,228,515 A * 7/1993 Tran ..... 165/166
6,289,977 B1 * 9/2001 Claudel et al. ..... 165/157
6,516,874 B1 * 2/2003 Mathur et al. ..... 165/166

FOREIGN PATENT DOCUMENTS

JP 53-056748 5/1978

* cited by examiner

*Primary Examiner*—Tho Duong
(74) *Attorney, Agent, or Firm*—Rader, Fishman & Grauer PLLC; Ronald P. Kananen

(57) ABSTRACT

A heat exchange unit includes metallic heat transfer members combined with each other. Each heat transfer member has a heat transfer face having opposite surfaces with which first and second heat exchange fluids come into contact, respectively. Welded-together flat portions of the heat transfer members are inserted into a fitting hole of an end plate. The fitting hole substantially coincides with an end shape of the combined heat transfer members and is sized to slidably receive welded-together flat portions such that the end plate and the received, welded-together flat portions contact each other. After insertion, the heat transfer members are welded to the end plate along the fitting hole so that, at the welded region, the heat transfer members and the end plate form an integral construction.

6 Claims, 8 Drawing Sheets

HEAT EXCHANGE UNIT

BACKGROUND OF THE INVENTION

1. Field of the Invention

The present invention relates a heat exchange unit, which comprises a plurality of heat transfer members, which are formed of a metallic thin sheet and combined in parallel and integrally with each other, and especially to such a heat exchange unit in which heat exchange fluid having a high pressure can be introduced between the heat transfer members.

2. Description of the Related Art

If there is a wish that heat transfer coefficient is increased to enhance heat exchange effectiveness, utilizing a heat exchanger by which heat exchange is made between a high temperature fluid and a low temperature fluid, a plate-type heat exchanger has conventionally been used widely. The plate-type heat exchanger has a structure in which a plurality of heat transfer members having a plate-shape are placed parallelly one upon another at prescribed intervals so as to form passages, which are separated by means of the respective heat transfer member. A high temperature fluid and a low temperature fluid flow alternately in the above-mentioned passages to make heat exchange through the respective heat transfer members. Japanese Laid-Open Patent Application No. S53-56748 describes an example of such a conventional plate-type heat exchanger. FIG. 8 is a cross-sectional view illustrating a schematic structure of the conventional heat exchanger.

The conventional heat exchanger 100 as shown in FIG. 8 is composed of a main body 101, a pair of separation walls 102 disposed vertically in the main body 101, a plurality of plate-shaped heat transfer members 103 placed between the pair of separation walls 102, a plurality of spacers 104 for keeping the heat transfer members 103 at prescribed intervals to form passages 110, and a pair of partition walls 105 for supporting the heat transfer members 103 and the spacers 104 to define independent passages for flow of heated fluid and non-heated fluid, respectively.

In general, the heat transfer member 103 used in the conventional plate-type heat exchanger having the above-described structure has a predetermined pattern of irregularity, which serves as a heat transfer face having the opposite surfaces with which heat exchange fluids are to come into contact. The heat transfer member 103 having such a predetermined pattern of irregularity has usually been put into practical use by subjecting a metallic thin sheet to a press forming-process utilizing a press-forming device.

In the conventional heat exchanger having the above-described structure, the heat transfer members 103 are placed in parallel with each other at small intervals through the spacers 104 having a function of a gasket.

When there exists a large difference in pressure between heat exchange fluids, which flow along the opposite surfaces of the heat transfer member 103, the difference in pressure of the heat exchange fluids may deform the spacers 104, thus making it impossible to separate properly the heat exchange fluids from each other and leading to improper change in distance between the heat transfer members 103. Such problems may disenable heat exchange to be carried out effectively. In addition, there also exists a problem that a heat exchange fluid having a higher pressure cannot be introduced into a passage between the heat transfer members.

SUMMARY OF THE INVENTION

An object of the present invention, which was made to solve the above-mentioned problems, is therefore to provide a heat exchange unit in which heat transfer members formed of a metallic sheet are directly welded together to form a reliable united body, thus making it possible to use heat exchange fluid having higher pressure and to make heat exchange in a reliable manner.

In order to attain the aforementioned object, a heat exchange unit of the first aspect of the present invention comprises a plurality of heat transfer members, which are formed of a metallic thin sheet into a predetermined shape and combined in parallel and integrally with each other, each of said heat transfer members being provided on at least a part thereof with a heat transfer face having opposite surfaces with which first and second heat exchange fluids are to come into contact, respectively, first gap portions through which said first heat exchange fluid is to pass and second gap portions through which said second heat exchange fluid is to pass being provided alternately between adjacent two heat transfer faces, and a first opening communicating with said first gap portions to cause the first heat exchange fluid to flow into and out from said first gap portions and a second opening communicating with said second gap portions to cause the second heat exchange fluid to flow into and out from said second gap portions being provided separately from each other, wherein:

each of said heat transfer members is formed into a rectangular shape, which has on respective sides thereof flat portions having a prescribed width;

of said plurality of heat transfer members, adjacent two heat transfer members between which said first gap portion is located are water-tightly welded together at the flat portions thereof on a side where said second opening is placed, and adjacent two heat transfer members between which said second gap portion is located are water-tightly welded together at the flat portions thereof on a side where said first opening is placed, and the adjacent two heat transfer members are closed on the side where said first opening is placed; and the plurality of heat transfer members as combined are inserted, at the side where said first opening is placed, into a fitting hole of an end plate, said fitting hole having a shape substantially coinciding with an end shape of said plurality of heat transfer members as combined on the side where said first opening is placed, and said plurality of heat transfer members are welded to said end plate along said fitting hole.

According to the first aspect of the present invention, the plurality of heat transfer members formed of the metallic thin sheet are placed in parallel with each other at prescribed intervals and are welded together at their peripheral portions except for the first and second openings for the heat exchange fluids into an integrally united body, and then the thus united body is welded, at the side where the first opening is placed, to the end plate so that the first opening is surrounded by the end plate. It is therefore possible to combine the plurality of heat transfer members together into the united body without using any spacers. No use of spacers makes it possible to increase an area of the heat transfer face facing the gap between the heat transfer members and an area of the opening for the heat exchange fluid as large as possible. In addition, the strength of the combined structure of the heat transfer members can be increased, thus coping with a case where there is a large difference in pressure between the heat exchange fluids. The distance between the heat transfer members can be kept constant, thus ensuring a uniform heat exchanging property. Further, the heat transfer members are welded directly together so that the united body of the heat transfer members can be fitted into a single fitting hole of the end plate. It is therefore possible to simplify the structure of the end plate, thus facilitating manufacture of the heat exchange unit. The state in which the first and second openings are separated from each other in an appropriate manner can be ensured by the end plate, thus enhancing freedom of design of the heat exchange unit. Accordingly, it is possible to place inlet and outlet for the heat exchange fluids in the heat exchange unit in a desired manner.

In the second aspect of the heat exchange unit of the present invention, there may be adopted a structure in which said end plate is composed of a plurality of frame members, said frame members are joined into a shape having in a center thereof a spatial portion serving as said fitting hole.

According to the second aspect of the present invention, the end plate has the thus combined structure in which the frame members are joined into the shape having the spatial portion, which serves as the fitting hole. As a result, it is possible to manufacture the end plate, without removing a portion of material for the end plate, corresponding to the fitting hole to be formed, thus leading to effective use of the material for the end plate. Therefore, manufacturing cost can be remarkably reduced and manufacturing efficiency can also be improved.

In the third aspect of the heat exchange unit of the present invention, the end plate may have a thickness, which is more than twice as much as a thickness of the heat transfer member.

According to the third aspect of the present invention, the end plate has a sufficient thickness, which is more than twice as much as a thickness of the heat transfer member, thus making it possible to easily combine base metal, i.e., the end plate and the heat transfer members, integrally with weld material through a welding process into an integrally united body and providing an excellent welding workability. In addition, the heat transfer members and the end plate can be joined firmly to each other, thus providing an improved strength of welded joint and avoiding defects of products, such as a leakage of fluids.

In the fourth aspect of the heat exchange unit of the present invention, there may be adopted a structure in which a first pair of heat transfer members between which said first gap portion is located are water-tightly seam-welded together at the flat portions thereof on the side where said second opening is placed, is combined with a second pair of heat transfer members between which said first gap portion is located are water-tightly seam-welded together at the flat portions thereof on the side where said second opening is placed, and then said first pair of heat transfer members and said second pair of heat transfer members are water-tightly welded together at the flat portions thereof on a side where said first opening is placed, into a united body; and each of said first gap portions serves as a passage for a fluid having a higher pressure, of said first and second heat exchange fluids.

According to the fourth aspect of the present invention, the first pair of heat transfer members between which the first gap portion is located are water-tightly seam-welded together at the flat portions thereof on the side where said second opening is placed, is combined with the second pair of heat transfer members between which the first gap portion is located are water-tightly welded together at the flat portions thereof on the side where said second opening is placed, and then the first pair of heat transfer members and the second pair of heat transfer members are water-tightly welded together in a predetermined region on the side where the first opening is placed, into a united body, so that the first opening serves as a passage for the heat exchange fluid having a higher pressure. More specifically, the heat transfer members between which the first gap portion is located, have a welded joint formed through the seam welding, so that the welded joint receives the high pressure of the heat exchange fluid passing through the first gap portion. Accordingly, there can be ensured the united body of the heat transfer members as seam-welded together at a high strength of welded joint so as to endure the high pressure-heat exchange fluid. A sufficient strength of the heat transfer members as welded together can be ensured. In addition, passing the high pressure-heat exchange fluid through the first gap portion applies pressure to the heat transfer members so that the welded edge portions of the heat transfer members on the side where the first gap portion is located come into close contact with each other. This avoids a need for increasing remarkably the strength of welded joint of the heat transfer members on the side where the first gap portion is located, thus reducing manufacturing cost.

In the fifth aspect of the heat exchange unit of the present invention, the end plate may be provided on each of opposite surfaces thereof with at least one recess, which is formed along the fitting hole and has a predetermined depth, said at least one recess serving as a welding groove for a welding operation.

According to the fifth aspect of the present invention, the end plate is provided on the periphery of the fitting hole with at lest one recess so that at least one groove-shaped space is formed between the end plate and each of the heat transfer members so as to serve as the welding groove for a welding operation. It is therefore possible to form welded joint utilizing the welding groove, thus avoiding welding defects and ensuring a sufficient strength of the welded portions. The welding operation can also be facilitated in an appropriate manner.

DETAILED DESCRIPTION OF THE PREFERRED EMBODIMENTS

Figure 1:
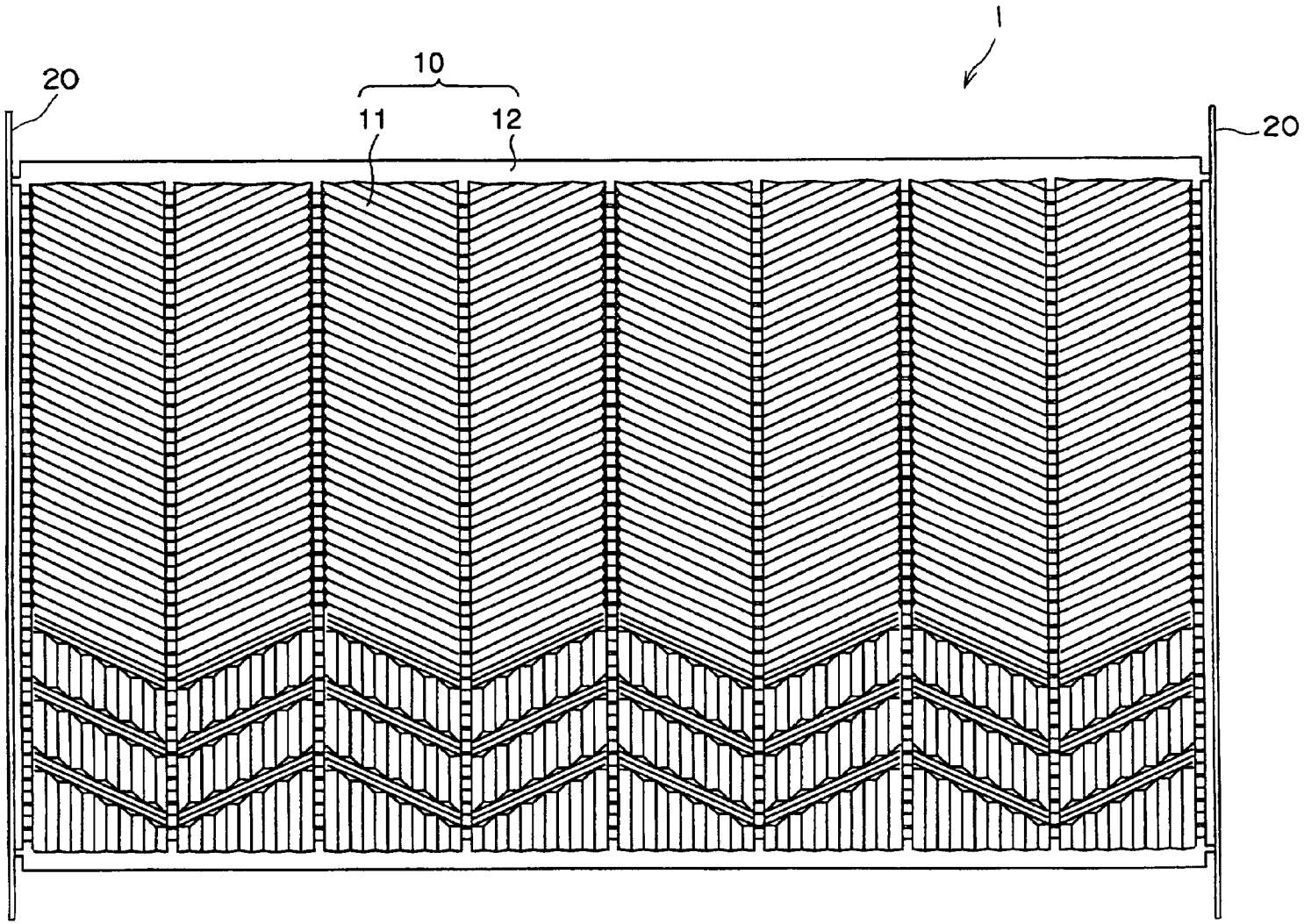
FIG. 1 is a front view illustrating a heat exchange unit according to an embodiment of the present invention.
Figure 2:
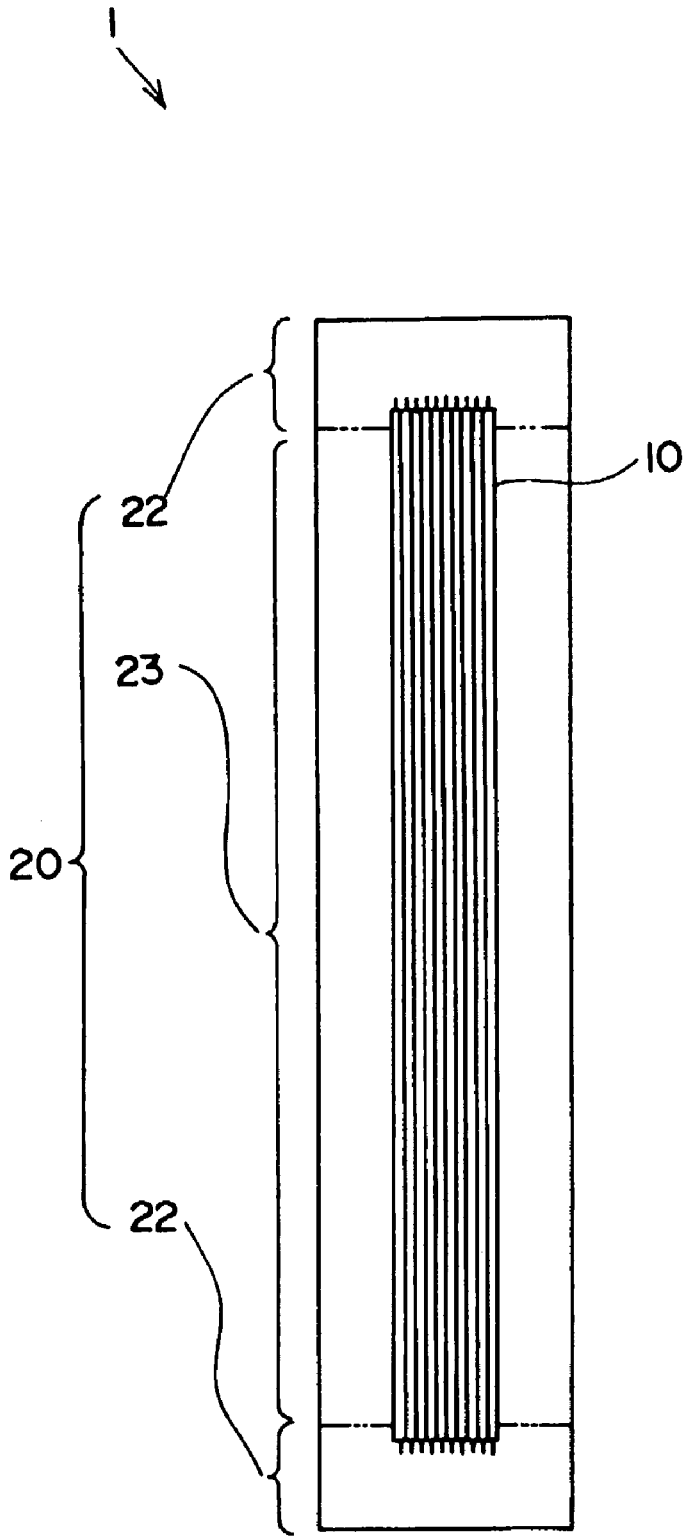
FIG. 2 is a side view illustrating the heat exchange unit according to the embodiment of the present invention.
Figure 3:
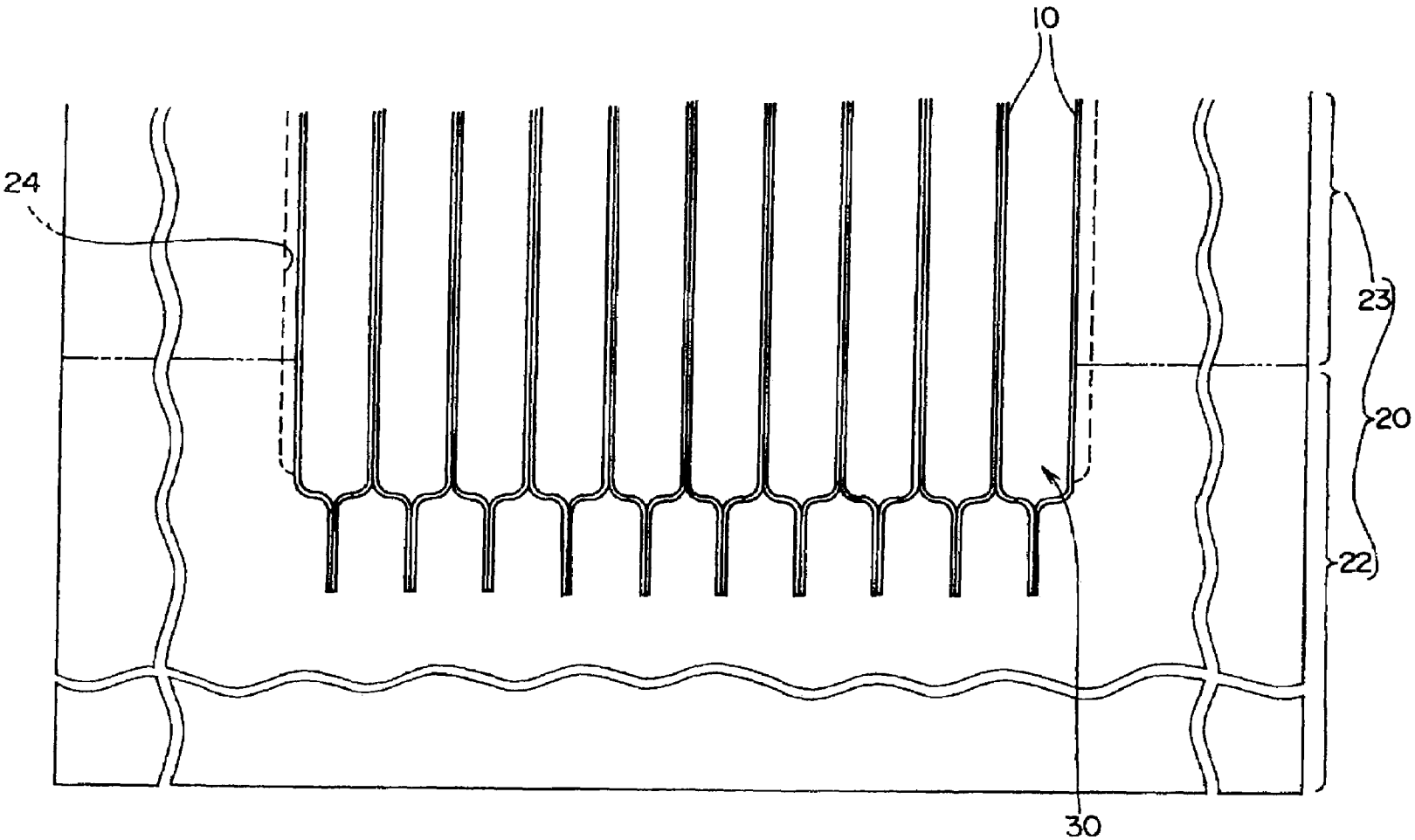
FIG. 3 is an enlarged partial side view illustrating essential elements of the heat exchange unit according to the embodiment of the present invention.
Figure 4:
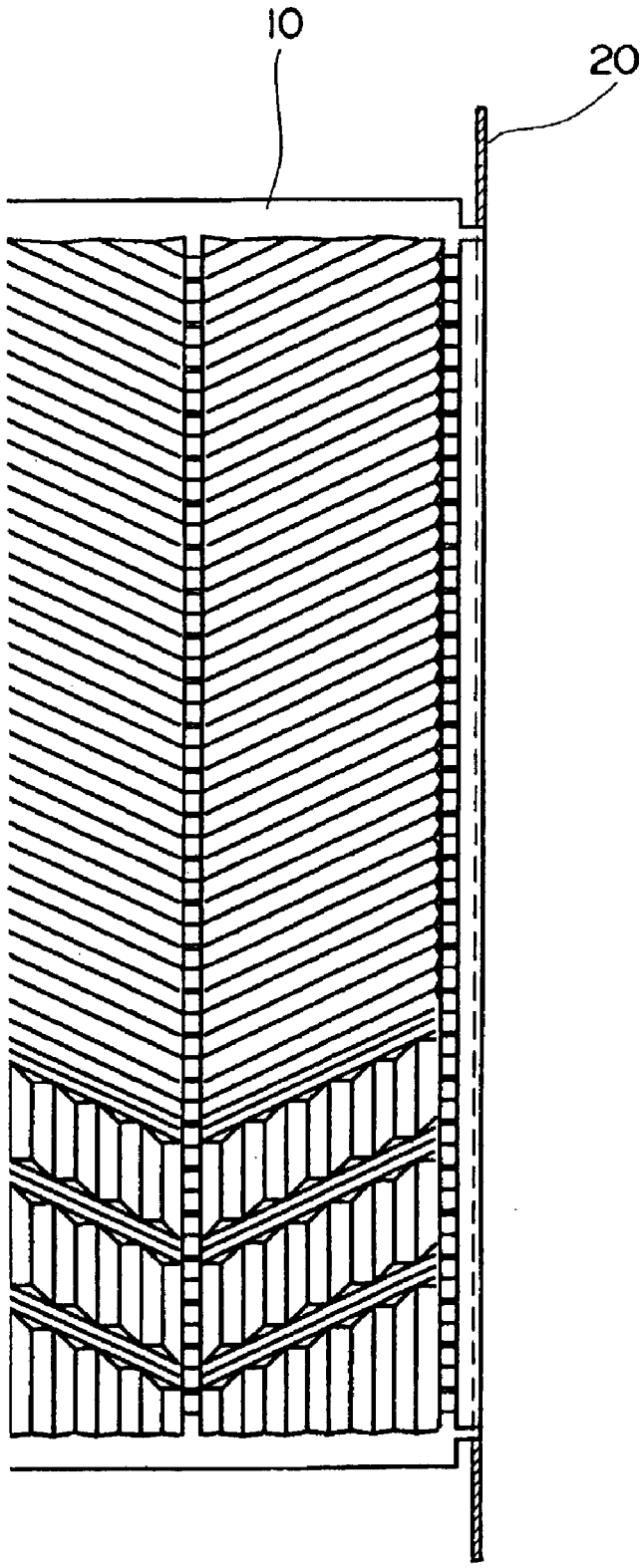
FIG. 4 is a longitudinal cross-sectional view of an end plate of the heat exchange unit according to the embodiment of the present invention.
Figure 5:
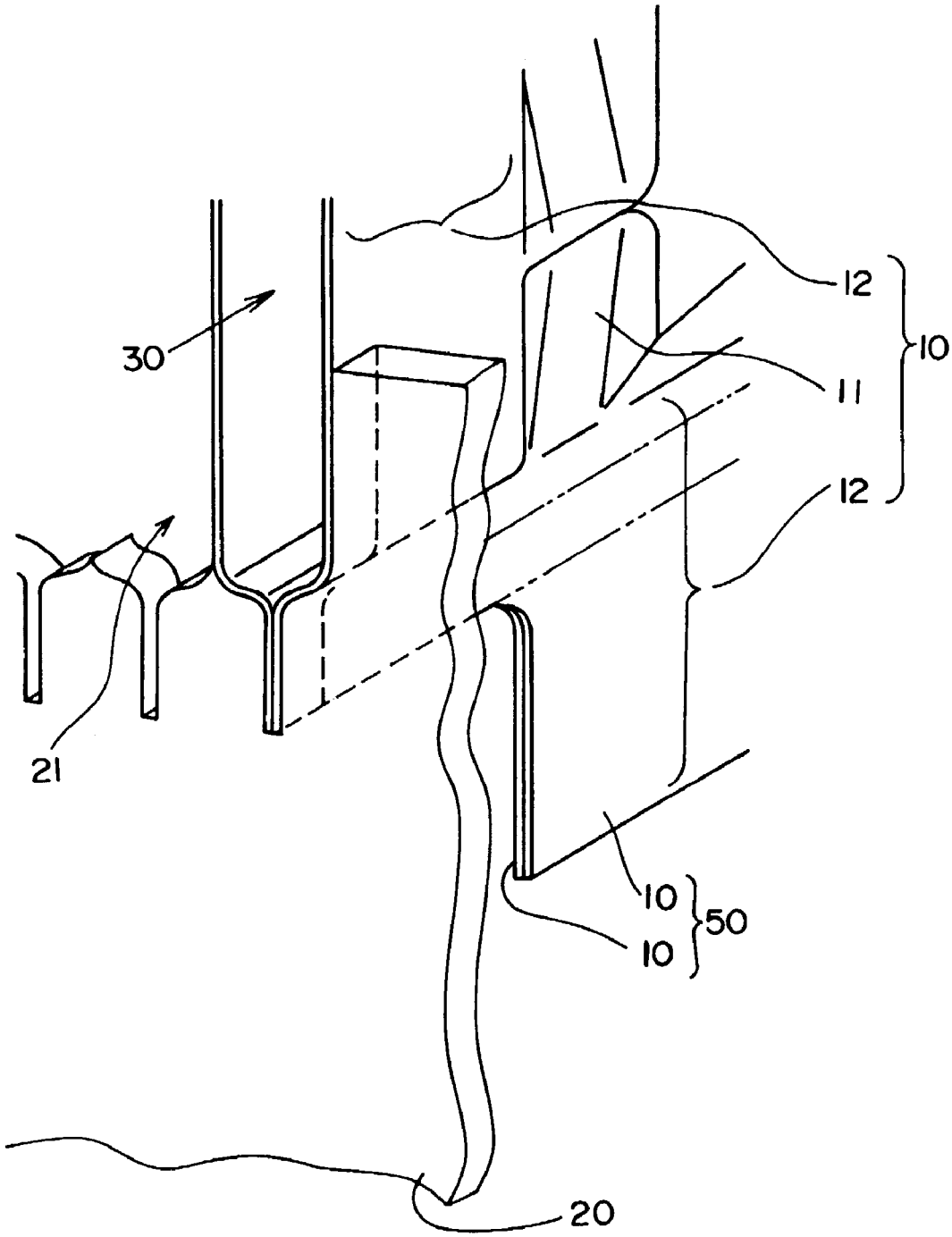
FIG. 5 is a descriptive view illustrating a state where heat transfer members are inserted in the end plate in the heat exchange unit according to the embodiment of the present invention.
Figure 6:
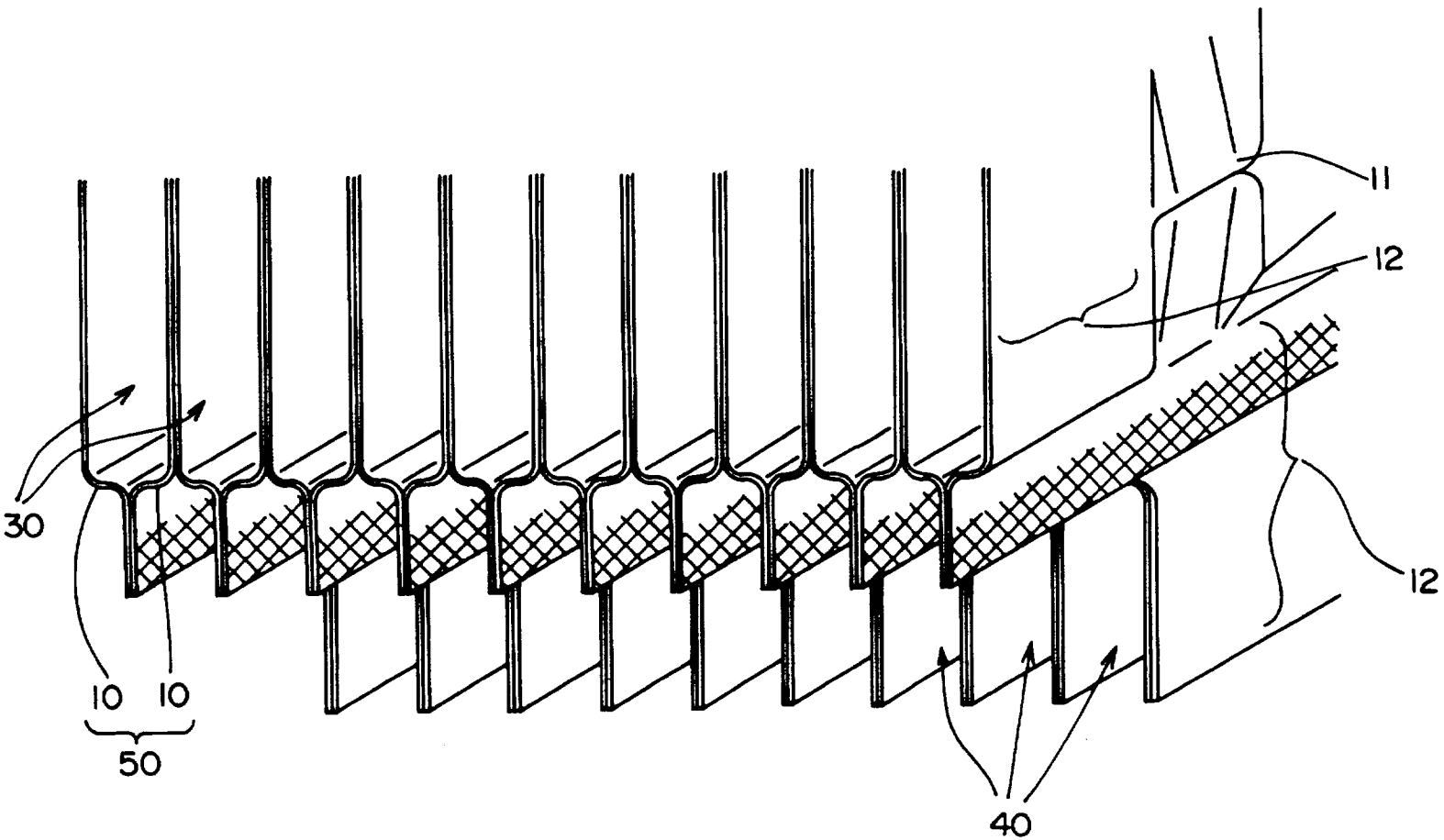
FIG. 6 is a descriptive perspective view illustrating a state where the heat transfer members are joined to each other into a united body.
Figure 7:
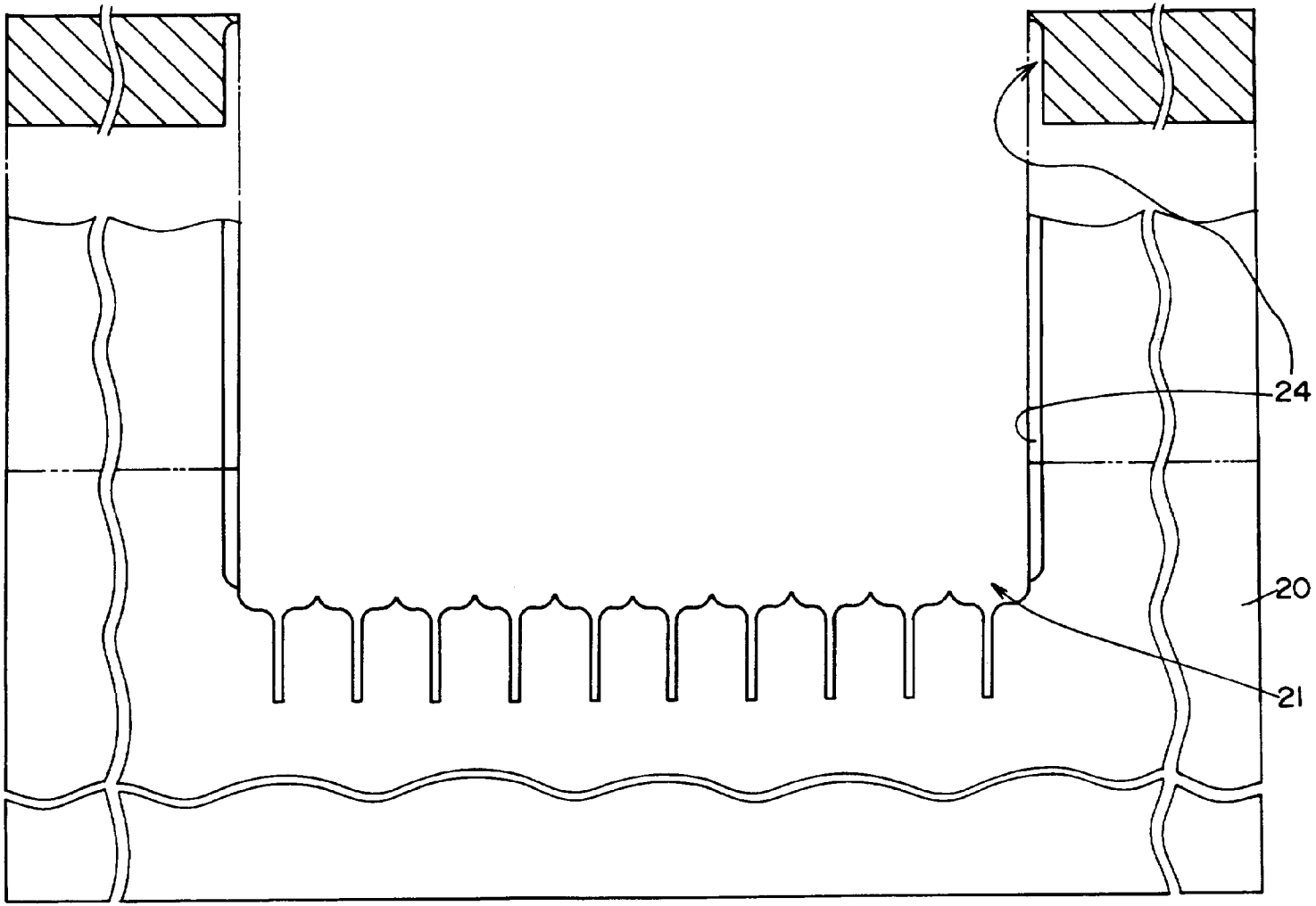
FIG. 7 is a descriptive view illustrating a back-side structure of the end plate of the heat exchange unit according to the embodiment of the present invention.
Figure 8:
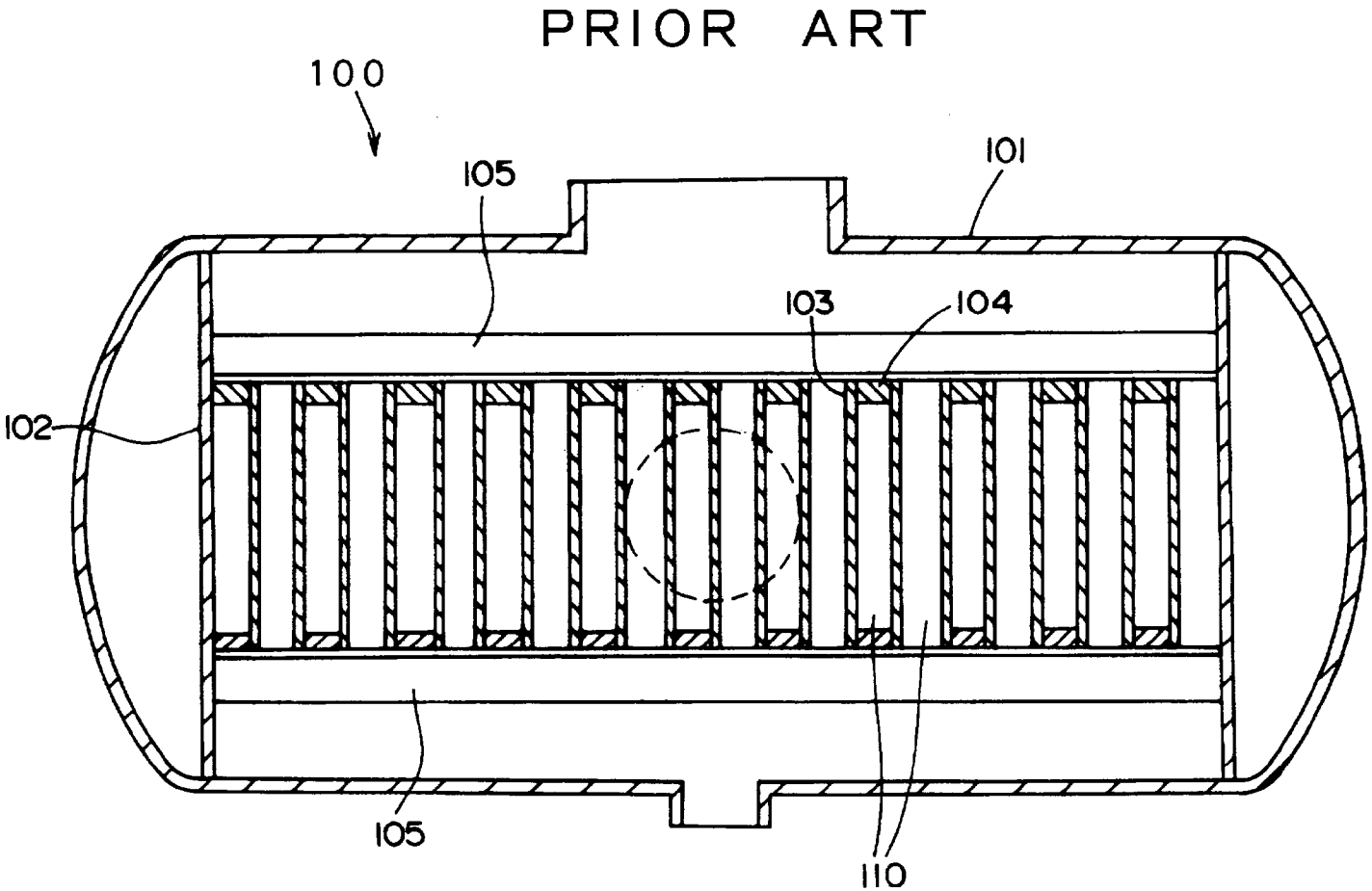
FIG. 8 is a schematic cross-sectional view illustrating a conventional heat exchanger.

Now, the embodiment of the present invention will be described in detail below with reference to FIGS. 1 to 7. FIG. 1 is a front view illustrating a heat exchange unit according to an embodiment of the present invention; FIG. 2 is a side view illustrating the heat exchange unit according to the embodiment of the present invention; FIG. 3 is an enlarged partial side view illustrating essential elements of the heat exchange unit according to the embodiment of the present invention; FIG. 4 is a longitudinal cross-sectional view of an end plate of the heat exchange unit according to the embodiment of the present invention; FIG. 5 is a descriptive view illustrating a state where heat transfer members are inserted in the end plate in the heat exchange unit according to the embodiment of the present invention; FIG. 6 is a descriptive perspective view illustrating a state where the heat transfer members are joined to each other into a united body; and FIG. 7 is a descriptive view illustrating a back-side structure of the end plate of the heat exchange unit according to the embodiment of the present invention.

As is clear from FIGS. 1 to 7, the heat exchange unit 1 according to the embodiment of the present invention includes a plurality of heat transfer members 10 and an end plate 20. Each of the heat transfer members 10 is formed of a metallic thin sheet into a predetermined shape and has a heat transfer face 11 having opposite surfaces with which heat exchange fluids, i.e., the first and second heat exchange fluids are to come into contact, respectively. The end plate 20 has a fitting hole 21 having a predetermined shape. The heat transfer members 10 are combined in parallel and integrally with each other into a united body. The heat transfer members 10 as combined are inserted at the end side of the united body into the fitting hole 21 of the end plate 20. The heat transfer members 10 and the end plate 20 are welded together, to constitute the heat exchange unit.

The metallic thin sheet having a rectangular shape is subjected to a press-forming process utilizing a predetermined press-forming apparatus (not shown) to form heat transfer faces 11 in a center of the metallic thin sheet and flat portions 12 on the respective sides of the metallic thin sheet, by which the heat transfer faces 11 are surrounded. Each of the above-mentioned heat transfer faces 11 is a region, which has the optimized pattern of irregularities, so that a high temperature heat exchange fluid (i.e., the first heat exchange fluid) is to come into contact with one surface of the heat transfer face 11 and a low temperature heat exchange fluid (i.e., the second heat exchange fluid) is to come into contact with the other surface thereof, in order to make heat exchange. The heat transfer face 11 having the pattern of irregularities has a wave-shaped cross section, which provides an excellent heat transfer property and groove portions through which condensed water can be discharged rapidly. The above-mentioned wave-shaped cross section and the groove portions are known and description of them will be omitted.

The heat transfer members 10 are combined in parallel and integrally with each other into the united body so that the first gap portions (not shown) through which the first heat exchange fluid and the second gap portions (not shown) through which the second heat exchange fluid are provided alternately. In order to combine the heat transfer members 10 into the united body, of the heat transfer members, adjacent two heat transfer members 10 between which the first gap portion is located are water-tightly welded together at the flat portions of the heat transfer members 10 on the opposite shorter sides thereof, to prepare the first set of heat transfer members 10. Then, the same step is carried out to prepare the second set of heat transfer members 10. The first and second sets of heat transfer members 10 are water-tightly welded together at the flat portions of the heat transfer members 10 on the opposite longer sides thereof. The plurality of sets of heat transfer members 10 are combined together in this manner to prepare the united body of the heat transfer members 10.

The thus prepared united body of heat transfer members 10 is provided on the opposite longer sides thereof with the first openings 30 for causing the first heat exchange fluid to flow in and from the first gap portions, on the one hand, and on the opposite shorter sides thereof with the second openings 40 for causing the second heat exchange fluid to flow in and from the second gap portions, on the other hand. The edges on the opposite longer sides of the heat transfer members 10, where the first opening 30 is placed, are closed.

The end plate 20 is composed of a plurality of frame members, each having a predetermined thickness, which is more than twice as much as the thickness of the heat transfer member 10. The end plate 20 is obtained by welding the frame members to form a fitting hole 21 in a center of the end plate 20. The fitting hole 21 has a shape, which substantially coincides with the shape of the end of the united body of the heat transfer members 10 in the direction of the longer side of the heat transfer member 10. The united body of the heat transfer members 10 is inserted at the end portion of the united body thereof into the fitting hole 21 of the end plate 20. The heat transfer members 10 and the end plate 20 are combined integrally with each other by applying a welding process to the contact areas of them along the fitting hole 21.

The frame members for the end plate 20 are classified into a pair of horizontal members 22, which come into contact with the opposite shorter sides of the heat transfer members 10, respectively, and another pair of vertical members 23, which connect the pair of horizontal members 22 to each other. Each of the horizontal members 22 has a serration portion, which receives the end of the united body of the heat transfer members 10. The horizontal members 22 and the vertical members 23 are provided, at their portions to be welded to the heat transfer members 10, with welding grooves for ensuring a reliable welded structure. The welding grooves are obtained by subjecting the portions of the horizontal members 22 and the vertical members 23 to a working process to remove edge portions thereof.

The horizontal members 22 and the vertical members 23, of which the end plate 20 is composed, are provided on each of their opposite surfaces with recesses 24 (see FIG. 7), which are formed along the fitting hole 21 and have a predetermined depth. When the end portion of the united body of the heat transfer members 10 is inserted into the fitting hole 21 of the end plate 20, the above-mentioned recesses 24 form groove-shaped spaces serving as welding grooves for a welding operation. It is possible to form welded joint utilizing the welding groove, thus ensuring a sufficient strength of the welded portions of the end plate 20 and the heat transfer members 10.

Now, description will be give below of an assembling operation for the heat exchange unit according to the embodiment of the present invention. The heat transfer member 10 (i.e., the first heat transfer member 10), which has been prepared through a press-forming operation utilizing a press-forming apparatus and discharged from the press-forming apparatus, is placed on the other heat transfer member 10 (i.e., the second heat transfer member 10), which has also been prepared in the same manner, so that the front surface of the first heat transfer member 10 faces the rear surface of the second heat transfer member 10 and the latter is placed upside down relative to the former.

When the first heat transfer member 10 is placed on the second heat transfer member 10 in this manner, the flat portions 12 on the shorter sides of the former come into close contact with the corresponding flat portions 12 on the shorter sides of the latter and projected portions of the heat transfer face 11 of the former come into close contact with corresponding projected portions of the heat transfer face 11 of the latter so that the other portions than the projected portions of the heat transfer face 11 of the former are separated from the other portions than the projected portions of the heat transfer face 11 of the latter so as to form gap portions in which the heat exchange fluids can flow, between the opposite heat transfer faces 11.

A part of each of the facing flat portions on the shorter sides of the first and second heat transfer members 10, which have been placed one upon another in a manner as mentioned above, is subjected to a seam welding to form a single assembly unit 50. A gap portion, i.e., the first gap portion is formed so as to be located between the heat transfer faces 11 of the heat transfer members of which the assembly unit is composed 50. An opened edge of the longer sides of the assembly unit 50 form the first opening 30, which communicates with the first gap portion (see FIG. 5). The first gap portion serves as a passage for the higher-pressure heat exchange fluid of the two heat exchange fluids.

The above-mentioned assembly unit (i.e., the first assembly unit) 50 is placed in parallel to the other assembly unit (i.e., the second assembly unit) 50, which has been prepared in the same manner, so that these assembly units 50 come into contact each other. When the first assembly unit 50 is placed on the second assembly unit 50 10 in this manner, the flat portions 12 on the longer sides of the former come into close contact with the corresponding flat portions 12 on the longer sides of the latter and the projected portions of the heat transfer face 11 of the former come into close contact with the corresponding projected portions of the heat transfer face 11 of the latter so that the other portions than the projected portions of the heat transfer face 11 of the former are separated from the other portions than the projected portions of the heat transfer face 11 of the latter so as to form gap portions in which the heat exchange fluids can flow, between the first and second assembly units 50.

The first and second assembly units 50 are welded together, at their flat portions 12 of the longer sides of the adjacent heat transfer members 10, into a united body as an intermediate product. In such a united body, the second gap portion is formed between the first and second assembly units 50. An opened edge of the shorter sides of the assembly unit 50 form the first opening 30, which communicates with the above-mentioned second gap portion (see FIG. 6). The second gap portion serves as a passage for the heat exchange fluid, which has a lower pressure than that of the heat exchange fluid passing through the first gap portion.

The above-described step for preparing the assembly unit 50 and the above-described step for welding the assembly units 50 together are repeated to prepare the united body as a finished product. The end portion on the longer side of the thus prepared united body of the assembly units 50 is inserted into the fitting hole 21 of the end plate 20. A welding step is applied to the outer periphery of the end portion of the united body of the heat transfer members thus inserted and the inner periphery of the fitting hole 21 of the end plate 20. The end plate 20 has a sufficient thickness relative to the heat transfer members 10, thus making it possible to easily combine base metal, i.e., the end plate 20 and the heat transfer members 10, integrally with weld material through a welding process into the integrally united body and providing an excellent welding workability. In addition, the heat transfer members and the end plate can be joined firmly to each other, thus providing an improved strength of welded joint. Thus, there is manufactured the heat exchange unit 1 in which all the heat transfer members 10 and the end plate 20 can be joined together through the welding operation.

In the thus manufactured heat exchange unit 1 in which the heat transfer members 10 are combined together, the end portion of the united body of the heat transfer members 10, which has the outer closed end structure, is inserted into the fitting hole 21 of the end plate 20 so that the end portion of the united body is surrounded by the end plate 20, thus causing the first opening 30 to be separated from the second opening 40 in a reliable manner. Heat exchange is made by causing the first heat exchange fluid to flow in and out from the first gap portion through the first opening 30, on the one hand, and causing the second heat exchange fluid to flow in and out from the second gap portion, which is located on the opposite side to the first gap portion relative to the heat transfer member 10, through the second opening 40. According to such a heat exchange unit in which the positional relationship between the first and second openings can be ensured by the end plate 20, it is possible to determine easily the positions of inlet and outlet portion for the heat exchange fluids in a desired manner upon manufacturing a heat exchanger utilizing the heat exchange unit 1, thus leading to application of the heat exchange unit 1 to heat exchange for many different purposes.

In the heat exchange unit of the embodiment of the present invention, the plurality of heat transfer members 10 formed of the metallic thin sheet are placed in parallel with each other at prescribed intervals and are welded together at their peripheral portions except for the first and second openings for the heat exchange fluids into the integrally united body, and then the thus united body is welded, at the side where the first opening 30 is placed, to the end plate 20 so that the first opening 30 is surrounded by the end plate 20. It is therefore possible to combine the plurality of heat transfer members 10 together into the united body without using any spacers. No use of spacers makes it possible to increase an area of the heat transfer face 11 facing the gap between the heat transfer members 10 and an area of the opening for the heat exchange fluid as large as possible. In addition, the strength of the combined structure of the heat transfer members 10 can be increased, thus coping with a case where there is a large difference in pressure between the heat exchange fluids. The distance between the heat transfer members 10 can be kept constant, thus ensuring a uniform heat exchanging property. Further, the heat transfer members 10 are welded directly together so that the united body of the heat transfer members 10 can be fitted into the single fitting hole 21 of the end plate 20 and there can be provided a simplified end plate 20 eliminating waste in cooperation with the fact that the end plate 20 has a combined structure in which the frame members are combined to form the fitting hole 21 in a center of the end plate. It is therefore possible to easily prepare the end plate and reduce remarkably the cost for preparation thereof.

In addition, in the heat exchange unit of the embodiment of the present invention, the first pair of heat transfer members 10 between which the first gap portion is located are water-tightly seam-welded together is combined with the second pair of heat transfer members between which the first gap portion is located are water-tightly welded together, and then the first pair of heat transfer members 10 and the second pair of heat transfer members 10 are water-tightly welded together in a predetermined region on the side where the first opening is placed, into the united body, so that the first opening serves as a passage for the heat exchange fluid having a higher pressure. More specifically, the heat transfer members 10 between which the first gap portion is located, have a welded joint formed through the seam welding, so that the welded joint receives the high pressure of the heat exchange fluid passing through the first gap portion. Accordingly, there can be ensured the united body of the heat transfer members 10 as seam-welded together at a high strength of welded joint so as to endure the high pressure-heat exchange fluid. A sufficient strength of the heat transfer members 10 as welded together can be ensured. In addition, passing the high pressure-heat exchange fluid through the first gap portion applies pressure to the heat transfer members 10 so that the welded edge portions of the heat transfer members 10 on the side where the first gap portion is located come into close contact with each other. This avoids a need for increasing remarkably the strength of welded joint of the heat transfer members 10 on the side where the first gap portion is located, thus reducing manufacturing cost.

In the above-described embodiment of the heat exchange unit according to the present invention, the pair of heat transfer members 10 between which the first gap portion is located are water-tightly seam-welded together so that the first gap portion is used as the passage for the high pressure heat exchange fluid. Alternatively, in case where there is a small difference in pressure between the heat exchange fluids, the heat transfer members 10 may be combined together through the different welding method, which ensures an appropriate strength of welded joint, or the lower pressure heat exchange fluid may flow in the first gap portion.

According to the present invention, the plurality of heat transfer members formed of the metallic thin sheet are placed in parallel with each other at prescribed intervals and are welded together at their peripheral portions except for the first and second openings for the heat exchange fluids into an integrally united body, and then the thus united body is welded, at the side where the first opening is placed, to the end plate so that the first opening is surrounded by the end plate. It is therefore possible to combine the plurality of heat transfer members together into the united body without using any spacers. No use of spacers makes it possible to increase an area of the heat transfer face facing the gap between the heat transfer members and an area of the opening for the heat exchange fluid as large as possible. In addition, the strength of the combined structure of the heat transfer members can be increased, thus coping with a case where there is a large difference in pressure between the heat exchange fluids. The distance between the heat transfer members can be kept constant, thus ensuring a uniform heat exchanging property. Further, the heat transfer members are welded directly together so that the united body of the heat transfer members can be fitted into a single fitting hole of the end plate. It is therefore possible to simplify the structure of the end plate, thus facilitating manufacture of the heat exchange unit. The state in which the first and second openings are separated from each other in an appropriate manner can be ensured by the end plate, thus enhancing freedom of design of the heat exchange unit. Accordingly, it is possible to place inlet and outlet for the heat exchange fluids in the heat exchange unit in a desired manner.

According to the present invention, the end plate has the thus combined structure in which the frame members are joined into the shape having the spatial portion, which serves as the fitting hole. As a result, it is possible to manufacture the end plate, without removing a portion of material for the end plate, corresponding to the fitting hole to be formed, thus leading to effective use of the material for the end plate. Therefore, manufacturing cost can be remarkably reduced and manufacturing efficiency can also be improved.

According to the present invention, the end plate has a sufficient thickness, which is more than twice as much as a thickness of the heat transfer member, thus making it possible to easily combine base metal, i.e., the end plate and the heat transfer members, integrally with weld material through a welding process into an integrally united body and providing an excellent welding workability. In addition, the heat transfer members and the end plate can be joined firmly to each other, thus providing an improved strength of welded joint and avoiding defects of products, such as a leakage of fluids.

According to the present invention, the first pair of heat transfer members between which the first gap portion is located are water-tightly seam-welded together at the flat portions thereof on the side where said second opening is placed, is combined with the second pair of heat transfer members between which the first gap portion is located are water-tightly welded together at the flat portions thereof on the side where said second opening is placed, and then the first pair of heat transfer members and the second pair of heat transfer members are water-tightly welded together in a predetermined region on the side where the first opening is placed, into a united body, so that the first opening serves as a passage for the heat exchange fluid having a higher pressure. More specifically, the heat transfer members between which the first gap portion is located, have a welded joint formed through the seam welding, so that the welded joint receives the high pressure of the heat exchange fluid passing through the first gap portion. Accordingly, there can be ensured the united body of the heat transfer members as seam-welded together at a high strength of welded joint so as to endure the high pressure-heat exchange fluid. A sufficient strength of the heat transfer members as welded together can be ensured. In addition, passing the high pressure-heat exchange fluid through the first gap portion applies pressure to the heat transfer members so that the welded edge portions of the heat transfer members on the side where the first gap portion is located come into close contact with each other. This avoids a need for increasing remarkably the strength of welded joint of the heat transfer members on the side where the first gap portion is located, thus reducing manufacturing cost.

According to the present invention, the end plate is provided on the periphery of the fitting hole with at least one recess so that at least one groove-shaped space is formed between the end plate and each of the heat transfer members so as to serve as the welding groove for a welding operation. It is therefore possible to form welded joint utilizing the welding groove, thus avoiding welding defects and ensuring a sufficient strength of the welded portions. The welding operation can also be facilitated in an appropriate manner.

What is claimed is:

1. A heat exchange unit, comprising:

an end plate having a fitting hole; and a plurality of heat transfer members, which are formed of a metallic thin sheet into a predetermined shape and combined in parallel and integrally with each other, each of said heat transfer members being provided on at least a part thereof with a heat transfer face having opposite surfaces with which first and second heat exchange fluids are to come into contact, respectively, first gap portions through which said first heat exchange fluid is to pass and second gap portions through which said second heat exchange fluid is to pass being provided alternately between adjacent two heat transfer faces, and a first opening communicating with said first gap portions to cause the first heat exchange fluid to flow into and out from said first gap portions and a second opening communicating with said second gap portions to cause the second heat exchange fluid to flow into and out from said second gap portions being provided separately from each other, wherein:

each of said heat transfer members is formed into a rectangular shape, which has on respective sides thereof flat portions having a prescribed width;

of said plurality of heat transfer members, adjacent two heat transfer members between which said first gap portion is located are water-tightly welded together at the flat portions thereof on a side where said second opening is placed, and adjacent two heat transfer members between which said second gap portion is located are water-tightly welded together at the flat portions thereof on a side where said first opening is placed, and the adjacent two heat transfer members are closed on the side where said first opening is placed;

the plurality of heat transfer members as combined are inserted, at the side where said first opening is placed, into the fitting hole of the end plate sized to slidably receive the welded-together flat portions such that the end plate and the received, welded-together flat portions contact each other, said fitting hole having a shape substantially coinciding with an end shape of said plurality of heat transfer members as combined on the side where said first opening is placed, and said plurality of heat transfer members are welded to said end plate along said fitting hole;

a first pair of heat transfer members between which said first gap portion is located are water-tightly seam-welded together at the flat portions thereof on the side where said second opening is placed, is combined with a second pair of heat transfer members between which said first gap portion is located are water-tightly seam-welded together at the flat portions thereof on the side where said second opening is placed, and then said first pair of heat transfer members and said second pair of heat transfer members are water-tightly welded together at the flat portions thereof on a side where said first opening is placed, into a united body;

each of said first gap portions serves as a passage for a fluid having a higher pressure, of said first and second heat exchange fluids; and said end plate is provided on each of opposite surfaces thereof with at least one recess, which is formed along said fitting hole and has a predetermined depth, said at least one recess serving as a welding groove for a welding operation.

2. The heat exchange unit as claimed in claim 1, wherein: said end plate is composed of a plurality of frame members, said frame members are joined into a shape having in a center thereof a spatial portion serving as said fitting hole.

3. The heat exchange unit as claimed in claim 1 or 2, wherein: said end plate has a thickness, which is more than twice as much as a thickness of the heat transfer member.

4. The heat exchange unit as claimed in claim 1, wherein: the welded-together flat portions and the fitting hole are configured in cross-section as rectangularly-shaped.

5. The heat exchange unit as claimed in claim 4, wherein: the fitting hole is defined by a first end plate surface and a second end plate surface facing the first end plate surface in a parallel manner, the first end plate surface contacting one of the welded-together flat portions and the second end plate surface contacting a remaining one of the welded-together flat portions.

6. The heat exchange unit as claimed in claim 5, wherein: a portion of the end plate and at least a portion of the welded-together flat portions while disposed in the fitting hole are welded together to form an integral construction.

* * * * *